US011470943B2

(12) United States Patent
Samangooie

(10) Patent No.: US 11,470,943 B2
(45) Date of Patent: Oct. 18, 2022

(54) MULTI-PURPOSE TOUCH FREE APPLICATOR WITH RESERVOIR

(71) Applicant: CaseMed Engineering, LLC, Waukegan, IL (US)

(72) Inventor: Casey Samangooie, Wadsworth, IL (US)

(73) Assignee: CaseMed Engineering, LLC, Waukegan, IL (US)

( * ) Notice: Subject to any disclaimer, the term of this patent is extended or adjusted under 35 U.S.C. 154(b) by 0 days.

(21) Appl. No.: 16/701,131

(22) Filed: Dec. 2, 2019

(65) Prior Publication Data

US 2021/0161275 A1 Jun. 3, 2021

(51) Int. Cl.
*B43K 5/14* (2006.01)
*A45D 34/04* (2006.01)
*A45D 37/00* (2006.01)

(52) U.S. Cl.
CPC ..... *A45D 34/04* (2013.01); *A45D 37/00* (2013.01); *A45D 2200/1018* (2013.01); *A45D 2200/1045* (2013.01)

(58) Field of Classification Search
CPC ..... A45D 2200/1045; A61M 35/003; A61M 35/006
USPC ..... 401/133
See application file for complete search history.

(56) References Cited

U.S. PATENT DOCUMENTS 3,116,732 A 1/1964 Cahill
3,386,793 A * 6/1968 Stanton ..... A61M 35/006 401/132
3,466,131 A 9/1969 Arcudi
3,986,640 A 10/1976 Redmond
3,998,559 A * 12/1976 Hoyt ..... A47L 13/17 401/132

(Continued)

FOREIGN PATENT DOCUMENTS

FR 2995769 B1 1/2016
GB 491053 A 8/1938

(Continued)

OTHER PUBLICATIONS

International Search Report for PCT/US2018/016374, International Filing Date Feb. 1, 2018, Date of completion of this opinion Mar. 25, 2018.

(Continued)

*Primary Examiner* — Jennifer C Chiang
(74) *Attorney, Agent, or Firm* — Flener IP & Business Law; Zareefa B. Flener

(57) ABSTRACT

A multi-purpose touch free applicator with reservoir is provided herein. The applicator includes at least one reservoir, a first film, at least one second film contained wholly within the reservoir and a pad. An enclosure defines an inner volume of the at least one reservoir and the enclosure has an opening at a proximal end of the at least one reservoir, wherein the boundary of the opening defines a perimeter of the reservoir. Further, the first film is fixedly attached to the perimeter of the enclosure and the first film has at least one frangible aperture within the perimeter of the reservoir. Moreover, the at least one second film divides the inner volume of the reservoir creating a plurality of distinct volumes within the inner volume of the reservoir. Finally, the pad is fixedly attached to the reservoir at the perimeter of the reservoir.

11 Claims, 10 Drawing Sheets

(56) References Cited

U.S. PATENT DOCUMENTS

| | | | | |
|---|---|---|---|---|
| 4,140,409 | A | 2/1979 | DeVries | |
| 4,183,684 | A * | 1/1980 | Avery, Jr. | A45D 34/04 401/133 |
| 4,430,013 | A | 2/1984 | Kaufman | |
| 4,475,835 | A | 10/1984 | Verboom et al. | |
| 4,526,176 | A * | 7/1985 | Bremer | A61B 5/25 600/392 |
| 4,800,904 | A | 1/1989 | Kinseley et al. | |
| 4,893,956 | A | 1/1990 | Wojcik et al. | |
| 4,963,045 | A | 10/1990 | Willcox | |
| 5,090,832 | A | 2/1992 | Rivera et al. | |
| 5,681,574 | A * | 10/1997 | Haber | A45D 34/04 424/401 |
| 5,775,826 | A * | 7/1998 | Miller | A45D 34/04 401/132 |
| 6,425,701 | B1 | 7/2002 | Jacobs | |
| 6,547,468 | B2 | 4/2003 | Gruenbacher et al. | |
| 7,108,440 | B1 | 9/2006 | Gruenbacher et al. | |
| 7,255,506 | B2 | 8/2007 | Gruenbacher et al. | |
| 7,264,414 | B2 | 9/2007 | McReynolds et al. | |
| 7,416,358 | B2 | 8/2008 | Legendre | |
| 7,507,047 | B2 | 3/2009 | Oberstadt et al. | |
| 7,575,384 | B2 | 8/2009 | Bauer et al. | |
| 7,631,645 | B2 | 8/2009 | Gayton et al. | |
| 7,651,290 | B2 | 1/2010 | Bauer et al. | |
| 7,674,058 | B2 | 3/2010 | Berger Sharp et al. | |
| 8,157,464 | B2 | 4/2012 | Prax | |
| 8,215,859 | B2 | 7/2012 | Kaufman et al. | |
| 8,425,136 | B2 | 4/2013 | Littig et al. | |
| 8,534,947 | B2 * | 9/2013 | Prax | A45D 34/04 401/133 |
| 8,631,941 | B2 * | 1/2014 | Fazzolari | A61M 35/003 206/532 |
| 8,814,455 | B2 | 8/2014 | Golden | |
| 8,910,830 | B2 | 12/2014 | May | |
| 8,926,212 | B2 | 1/2015 | Gundersen | |
| 9,022,679 | B2 | 5/2015 | Samangooie | |
| 2002/0032943 | A1 | 3/2002 | James et al. | |
| 2002/0197094 | A1 | 12/2002 | Gruenbacher | |
| 2004/0109720 | A1 * | 6/2004 | Gruenbacher | A45D 34/04 401/133 |
| 2005/0284777 | A1 | 12/2005 | Wilkman | |
| 2006/0039742 | A1 | 2/2006 | Cable, Jr. et al. | |
| 2007/0053737 | A1 * | 3/2007 | Morris | A45D 40/0087 401/133 |
| 2007/0183836 | A1 * | 8/2007 | Lampe | B05C 17/002 401/134 |
| 2008/0317389 | A1 | 12/2008 | Pung et al. | |
| 2010/0239353 | A1 | 9/2010 | Prax | |
| 2012/0022474 | A1 * | 1/2012 | Adoni | A61K 9/703 604/307 |
| 2018/0303566 | A1 * | 10/2018 | Soundararajan | A61B 17/3496 |
| 2018/0333566 | A1 | 11/2018 | Follman et al. | |
| 2020/0214423 | A1 | 7/2020 | Samangooie | |

FOREIGN PATENT DOCUMENTS

| | | | |
|---|---|---|---|
| GB | 1562640 | A | 3/1980 |
| WO | 2010101474 | A1 | 9/2010 |

OTHER PUBLICATIONS

International Search Report for PCT/US2017/037066, International Filing Date Jun. 12, 2017, Date of completion of this international search Jul. 28, 2017.

Written Opinion of the ISA for PCTUS18/16374, International Filing Date Feb. 1, 2018, Date of completion of this opinion Mar. 25, 2018.

Written Opinion of the ISA for PCT/US2017/037066, International Filing Date Jun. 12, 2017, Date of completion of this opinion Jul. 28, 2017.

* cited by examiner

MULTI-PURPOSE TOUCH FREE APPLICATOR WITH RESERVOIR

CROSS REFERENCE TO RELATED APPLICATIONS

This application is a continuation-in-part of PCT/US2017/037066, filed Jun. 6, 2017, and claims the benefit of U.S. Provisional Application No. 62/940,082, filed Nov. 25, 2019.

TECHNICAL FIELD

The disclosed applicator relates to the field of handheld, liquid, cream, and/or gel applicators.

BACKGROUND

The application of a cream, polish, remover, repellant, or medicine usually requires the user to either place the substance from a container onto a cotton ball or swab or to place the substance directly on the surface it is being applied to. Doing so may result in too much of the substance being place onto the surface or onto the cotton ball or swab. Further, such direct contact by the user may result in contamination of the substance or an adverse reaction if the substance contacts the skin or other organ of a user. A device that could eliminate possible contamination and adverse reactions would be useful in the application of such substances.

SUMMARY

The disclosed applicator is a multi-purpose touch free applicator comprising at least one reservoir, a first film, optionally, at least one second film wholly contained within the at least one reservoir, an application layer, and an external sealing layer. The at least one reservoir is defined by an applicator housing wherein the housing has an opening at the proximal end of the at least one reservoir and defining a reservoir perimeter. The applicator includes a first film that is welded or sealed to the applicator housing around the reservoir perimeter and around the housing perimeter and has at least one frangible aperture within the reservoir perimeter. The applicator also may have at least one second film contained wholly within the reservoir and dividing the inner volume of the reservoir into a plurality of distinct volumes. The at least one divider film further has at least one frangible aperture. The sealing layer in the form of a sealing label covers the application layer to eliminate contamination of the application layer, spoliation of the reservoir contents, and/or leakage of the reservoir contents, all prior to use of the applicator.

The disclosed applicator also refers to applicators that comprise at least one reservoir, a first film, optionally, at least one second film, an application layer, and, optionally, an external sealing layer. The at least one reservoir is defined by an enclosure wherein the enclosure has an opening at the proximal end of the at least one reservoir. Further, the boundary of the opening defines a perimeter of the reservoir. Moreover, the disclosed applicator contains a first film that is fixedly attached to the perimeter of the enclosure and has at least one frangible aperture within the perimeter of the at least one reservoir. The disclosed applicator may also have at least one second film. The at least one second film divides the inner volume of the reservoir to create a plurality of distinct volumes within the inner volume of the reservoir. The at least one second film further has at least one frangible aperture.

DETAILED DESCRIPTION

Figure 1:
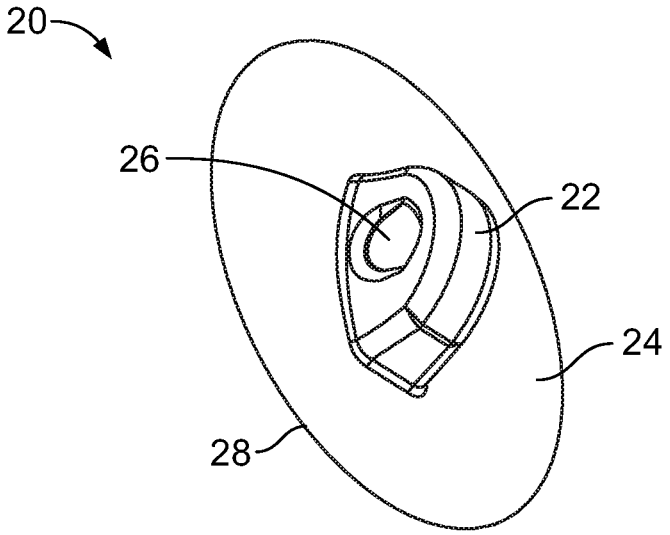
FIG. 1 is an example embodiment of an upper portion of an applicator from a top view.

The following detailed embodiments presented herein are for illustrative purposes. That is, these detailed embodiments are intended to be exemplary of the disclosed applicator for the purposes of providing and aiding a person skilled in the pertinent art to readily understand how to make and use of the disclosed applicator.

Accordingly, the detailed discussion herein of one or more embodiments is not intended, nor is to be construed, to limit the metes and bounds of the patent protection afforded the disclosed applicator, in which the scope of patent protection is intended to be defined by the claims and equivalents thereof. Therefore, embodiments not specifically addressed herein, such as adaptations, variations, modifications, and equivalent arrangements, are considered to be implicitly disclosed by the illustrative embodiments and claims described herein and therefore fall within the scope of the disclosed applicator.

Further, it should be understood that, although steps of various claimed methods may be shown and described as being in a sequence or temporal order, the steps of any such method are not limited to being carried out in any sequence or order, absent an indication otherwise. That is, any claimed method steps are considered capable of being carried out in any sequential combination or permutation order while still falling within the scope of the disclosed applicator.

Additionally, it is important to note that each term used herein refers to that which a person skilled in the relevant art would understand such term to mean based on the contextual use of such term herein. To the extent that the meaning of a term used herein, as understood by the person skilled in the relevant art based on the contextual use of such term, differs in any way from any particular dictionary definition of such term, it is intended that the meaning of the term as understood by the person skilled in the relevant art should prevail.

Furthermore, a person skilled in the art of reading the claims of the disclosed applicator should understand that "a" and "an" each generally denotes "at least one," but does not exclude a plurality unless the contextual use dictates otherwise. And that the term "or" denotes "at least one of the items," but does not exclude a plurality of items of the list.

The disclosed applicator device 10 is a device that allows for contents to be held separate until they are to be applied to a surface. The applicator device 10 also acts as a buffer between the reservoir contents and the user. Further, the applicator device 10 allows for controlled combinations of distinct contents in at least one reservoir within the applicator. Moreover, certain contents may cause a reaction with the skin of a user and, further, the prepackaged amount of contents ensure the proper quantity of the contents is used. The applicator device 10 is operated by first applying a force or pressure to at least one reservoir 22 within the upper portion 20 of the applicator device 10. The force or pressure applied to the at least one reservoir 22 increases the pressure inside the reservoir causing the reservoir contents, in a first embodiment of the present invention, to exert a force upon the at least one frangible aperture within a first film 34 covering the dispensing end 130 of the upper portion 20 of the applicator device 10. Once enough force is exerted upon the at least one frangible aperture, the aperture bursts transitioning from a first, closed state to a second, open state allowing the reservoir content to flow through to an absorbent application layer 36. Once the reservoir contents are absorbed by the application layer 36, the contents may then be applied to the desired surface.

Figure 2:
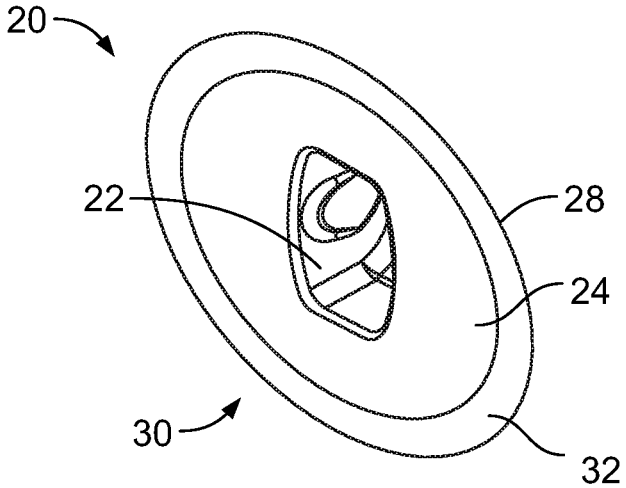
FIG. 2 is an example embodiment of an upper portion of an applicator from a bottom view.

Turning now to FIGS. 1 and 2, these figures illustrate an example embodiment of an upper portion 20 of an applicator device 10 from top and bottom views. In brief, the figure depicts a first reservoir 22, at least a first engagement point 26, a protective film 24, and a first, outer perimeter 28. In an example embodiment, the reservoir 22 may also contain engagement points 26. The engagement points 26 are placed on the reservoir 22 and may take the form of ridges, divots, or indentations in certain embodiments. These engagement points 26 may provide ergonomic comfort, and in another embodiment, may provide guidance as to how and where to apply the pressure required to burst either a capsule 56 within the reservoir 22, a divider film 40 within the reservoir 22, or frangible aperture 48, 50, 52 within the first film 34 between the reservoir 22 and the application layer 36, all of which utilize the at least one frangible aperture 48, 50, 52 to access the application layer 36.

Figure 3:
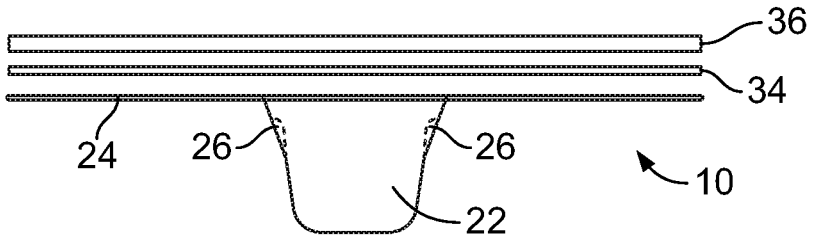
FIG. 3 is an example embodiment of an applicator in an exploded view.

The applicator device 10 is assembled by first securely affixing the upper portion 20 to a first film 34 (shown in FIG. 3). The upper portion 20 and the first film 34 are affixed together through a heat and pressure seal or weld at the perimeter 28 of the protective film 24. The heat and pressure seal or weld ensures contents remain sealed within the reservoir 22 while the applicator device 10 is not in use or is in transport. Next, an absorbent application layer 36 is affixed to the first film 34 so that the first film 34 is between the application layer 36 and the reservoir 22. The application layer 36 is also affixed to the reservoir 22 by way of a heat and pressure seal at the perimeter 28 of the protective film 24. Similarly, this heat and pressure seal acts to ensure the contents of the reservoir 22 are absorbed by the application layer 36 and do not leak out of a side of the applicator device 10. Further, the application layer 36 and the reservoir 22 are in fluid communication such that when contents leave the reservoir 22, they flow through the first film 34 via at least one frangible aperture 48, 50, 52 (FIGS. 8A-8C) and onto the application layer 36. The application layer 36 is then soaked with the contents 56 of the reservoir 22 and can then be applied to a surface.

In an example embodiment, the first film 34 comprises at least one frangible aperture 48, 50, 52 which allows the contents 56 of a reservoir 22 to access the application layer 36. To access the application layer 36, the at least one frangible aperture 48, 50, 52 must be ruptured or burst. To rupture or burst the at least one frangible aperture 48, 50, 52, a force or pressure must be applied to reservoir 22. Such application of force or pressure, in one embodiment, may be applied directly to the engagement point 26 on the reservoir 22. In another embodiment, the force or pressure may be applied anywhere on the reservoir 22. Once the force or pressure is applied to the reservoir 22, there is a buildup of internal pressure within the reservoir 22 that then causes the frangible aperture 48, 50, 52 to rupture or burst.

Figure 8A:
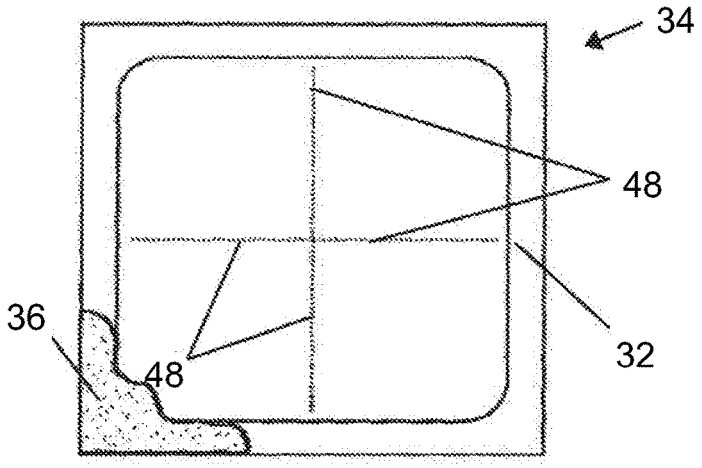
FIG. 8A-C are example embodiments of an at least one frangible aperture in the first film.

In one embodiment, the frangible aperture is a plurality of micro-perforations 48 that can be seen in FIG. 8A. In such an embodiment, the micro-perforations 48 are 1-3 millimeters apart and preferable have a rupture or burst strength of 0.5-1.0 psi. In one embodiment, the plurality of micro-perforations 48 forms an X pattern. The X pattern, when torn, creates a large opening through which liquid can flow. However, in some embodiment, other geometric patterns may be used. In yet other embodiments, the frangible aperture is a plurality of macro-perforations.

Figure 8B:
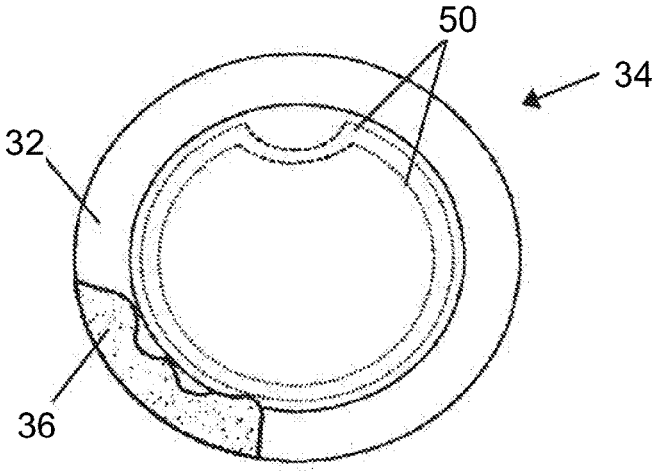

In another embodiment, the frangible aperture is a set of seals 50 as can be seen in FIG. 8B. In such an embodiment, the first film 34 does not have micro-perforations. Rather, there is a pair of U-shaped lines of differential sealing. To create such an example embodiment, a sheet of the first film 34 is aligned against a corresponding end of an upper portion 20 of an applicator device 10 and sealed in two steps. The form/fill/seal apparatus seals the two layers around approximately ⅞ of the perimeter 28 with a first pressure. Then, the apparatus seals the remaining ⅛ of the perimeter 28 with a weaker seal, in a U-shaped line. By applying a force or pressure to the reservoir, the contents 56 of the reservoir 22 or the air within the reservoir 22 will cause the weaker seal to rupture or burst. Once the weaker seal is ruptured or burst, the contents 56 of the reservoir 22 may flow through to the application layer 36. In an example embodiment, a force or pressure of 0.5-1.0 psi will cause the weaker seal to rupture or burst. In other embodiments, the second weaker seal may take the form a different shape such as, but not limited to, a triangle or oval. In yet another embodiment, the second weaker seal may be a fluid continuation of the shape of the first seal. In such an embodiment, there may be an identifying mark on the upper portion 20 of the applicator 10 to indicate the location of the weaker seal.

Figure 8C:
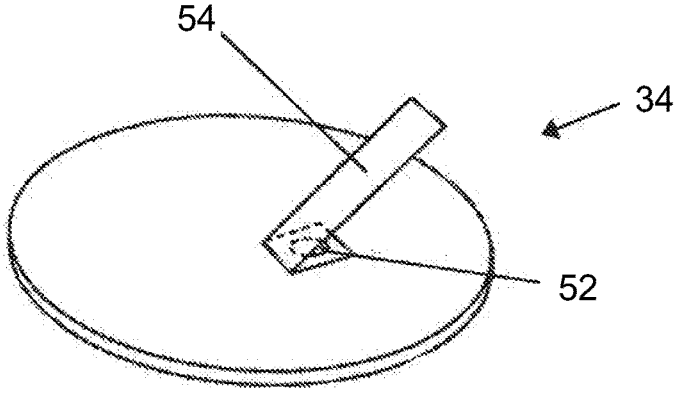

In yet another embodiment, the frangible aperture is a port 52 covered by a pull tab 54 as can be seen in FIG. 8C. The pull tab 54 extends past the first, outer perimeter 28 and once pulled, creates an opening 52 that allows the contents of the reservoir 22 to flow through to the application layer 36. The pull tab 54 can be used with any embodiment of the frangible aperture 48, 50, 52 and is configured to allow fluid communication between the contents of the reservoir 22 and the application layer 36 when dislocated during use. In another embodiment, the frangible aperture is a port 52 that is not covered by a pull tab 54. In such an embodiment, the port 52 may contain a piece that allows for contents to travel through the port 52 but only after a requisite amount of pressure or force is applied to the upper portion 20 of the applicator 10. Such a piece may also allow for contents to only travel in one direction, i.e., from the reservoir 22 to the application layer 36, in another embodiment. In such an embodiment, the piece allowing travel in only one direction keeps the reservoir 22 free from backwash and possible contamination.

The size and the shape of the reservoir 22 may vary depending on the contents 56 within the reservoir 22 as well as the intended use of the applicator. In one embodiment, the reservoir 22 may take the form of a circle. In another embodiment, the reservoir 22 may take the form of a square or rectangle. In yet another embodiment, the reservoir 22 may take the form of a truncated pyramid or a truncated cone. In another embodiment, the reservoir 22 may take the form of a "T". In some example embodiments, the shape of the upper portion of the applicator 20 has rounded edges. An applicator device 10 with such rounded edges is gentler on the user's hands. In another example embodiment, the upper portion of the applicator has squared and angled edges. An applicator device 10 with such squared or angled edges minimizes manufacturing waste. The overall dimensions of the applicator device 10 vary depending on the use of the applicator device 10. In one example embodiment, the applicator device 10 is 50.8 mm squared, to fit into a user's hand. These are merely example embodiments and, as such, should not be taken to limit the scope of the disclosure as the shape and size of the reservoir 22 will vary depending on the contents within and the intended use of the applicator.

Returning now to FIG. 2, this figure illustrates an example embodiment of an upper portion 20 of an example applicator device 10 with at least one reservoir 22 from a bottom view. In brief, the figure depicts a reservoir 22, a dispensing end 30, the protective film 24, a perimeter 28 of the protective film 24, and a first seal area 32. As discussed above, a first film 34 is fixedly attached to the upper portion 20 of the applicator device 10. The first film 34 is attached to the upper portion 20 of the applicator 10 by way of a heat and pressure seal. The first film 34 is heat and pressure sealed to the upper portion 20 of the applicator device 10 along the perimeter 28 of the protective film 24 creating a first, outer seal in the first seal area 32. The first, outer seal ensures that contents within the reservoir 22 remain in the reservoir 22 until use or during transport or storage of the applicator device.

In another embodiment, the first film 34 and at least one second, divider film 40 may be sealed to the upper portion 20 of the applicator device 10 using other thermal welding techniques which includes, but is not limited to, hot gas welding, hot wedge welding, extrusion welding, hot plate welding, infrared welding, and laser welding. In another embodiment, the first film 34 and the at least one second film 40 may be sealed to the upper portion of the applicator 20 using mechanical welding techniques which include, but are not limited to, spin welding, stir welding, vibration welding, and ultrasonic welding. In yet another embodiment, the first film 34 and the at least one second film may be sealed to the upper portion 20 of the applicator device 10 using electromagnetic welding techniques, which include, but are not limited to, resistance/implant/electrofusion welding, induction welding, dielectric welding, and microwave welding.

Once an applicator device 10 is ready to be used, the at least one frangible aperture 48, 50, 52 is ruptured or burst as discussed above, transforming the at least one frangible aperture from a first, closed state to a second, open state. Once the at least one frangible aperture 48, 50, 52 is ruptured or burst, the contents 56 of the reservoir 22 may flow through to the application layer 36 through the dispensing end 30. The at least one frangible aperture 48, 50, 52 may be placed anywhere within the first, outer perimeter 28 of the upper portion 20 of the applicator 10. In some embodiments, the at least one frangible aperture 48, 50, 52 is placed, along with other frangible apertures 48, 50, 52, in a concentrated area to deliver a targeted amount of content 56 from the reservoir 22 to a specific portion of the application layer 36. In some other embodiments, the at least one frangible aperture 48, 50, 52 are spaced evenly throughout the first film 34, within the perimeter 28 of the protective film 24, to allow for even absorption of the contents 56 of the reservoir 22 by the application layer 36. Such an embodiment, for example, may be useful in a medical application such as a sterilization process before surgery. An antiseptic, for example, may be placed within the reservoir 22 in one embodiment. In the same embodiment, the evenly spaced at least one frangible aperture 48, 50, 52 would allow the application layer 36 to be evenly coated with the antiseptic—ensuring that the area to be cleaned prior to surgery is evenly coated with the antiseptic.

Figure 6:
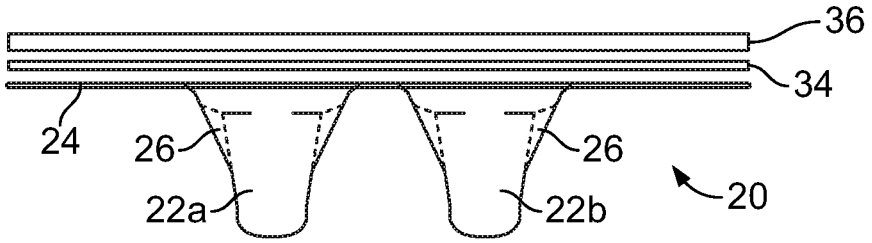
FIG. 6 is an example embodiment of an applicator with a plurality of reservoirs in an exploded view.

Turning now to FIGS. 3 and 6, these figures illustrate example embodiments of the applicator device 10 in an exploded view. The figures show an upper portion 20 of an applicator device 10, a first film 34, and the application layer 36. Each of these three elements is created at different stations of a form/fill/seal apparatus known in the art, then heat and vacuum sealed together as one unit. In particular, the upper portion 20 of the applicator device 10 is shaped from a roll of forming film. The forming film is a co-extruded composite shall be liquid-impermeable, sufficiently rigid to hold its own shape, yet sufficiently flexible to yield under the pressure of a user's fingers. In an example the upper portion 20 of the applicator device 10 is extruded from a thermoplastic material. For example, in some embodiments, the thermoplastic material may be either polyethylene with polypropylene, polyethylene with polyamide, polypropylene with polyamide, and polyvinyl carbonate. In some example embodiments, these materials may be medical grade to ensure that certain criteria are met for medical and pharmaceutical applications of the applicator device. In some embodiments, it may be necessary to ensure that the materials chosen to create the upper portion 20 of the applicator 10 protects against microbiological contamination, oxidation, evaporation, or moisture. Further, for some medical applications, it is important that the contents of the applicator device 10 remain free from sunlight. Thus, in some example embodiments, the thermoplastic materials chosen to make the upper portion 20 of the applicator 10 are tinted or completely darkened to ensure sunlight or light does not contact the contents 56 of the reservoir 22. In an example embodiment, the upper portion 20 of the applicator device 10 is 5 mil thick. In another embodiment, the upper portion 20 of the applicator device 10 is 2-12 mil thick. In yet another example embodiment, the thickness of the upper portion 20 of the applicator device 10 is determined relative to the particular contents 56 of the reservoir 22 by a person skilled in the art.

An example embodiment of a method to create an applicator device 10 is as follows. A roll of material for the upper portion 20 of the applicator device 10 is loaded onto one station of a form/fill/seal apparatus. The material is unrolled into the form of a sheet and is then pressed into the desired three-dimensional shape. From a single sheet, the form section of the apparatus presses multiple rows and columns of the upper portion 20 of the applicator device 10. This sheet indexes to a second station, where each reservoir is filled with a predetermined amount of content 56. This sheet then indexes to a third station, where a roll of the material to be used for the first film awaits. The roll of material for the first film is laid over the sheet of filled reservoirs and is heat and pressure sealed. The contents 56 are thereby enclosed within the upper portion 20 of the applicator device 10. The enclosed upper portion 20 of the applicator device 10 then travels to a fourth station, where a roll of application layer 36 material awaits. The apparatus unrolls the pad into a sheet and lays it atop the dispensing end 30 of the upper portion 20 of the applicator device 10. The three layers then travel as a single sheet to a fifth station where the application layer 36 is heat and pressure sealed to the first film 34 side. Finally, the sheet of applicators 10 indexes to a sixth station where it is slit and cut into individual units.

Further, the first film 34 and the second, divider film 40 are extruded from a thermoplastic material. For example, in some embodiments, the thermoplastic material may be either polyethylene with biaxially oriented polypropylene, polyethylene with polyester, polypropylene with biaxially oriented nylon, polypropylene with biaxially oriented polypropylene, polypropylene with polyester and polypropylene with biaxially oriented nylon. In some embodiments, these materials may be medical grade to ensure that certain criteria are met for medical and pharmaceutical applications of the applicator device. The thickness of the polyethylene and polypropylene may be any thickness understood in the art to be effective for the particular configuration being used of the applicator device 10. For example, in some embodiments, the thickness is between about 1 mil to 4 mil thick, or in other embodiments is approximately 2 mil thick. The thickness can be varied by those skilled in the art to optimize the storage and rupturing requirements of particular contents 56 of the reservoir 22. In some embodiments, the biaxially oriented polypropylene, biaxially oriented nylon and polyester are ideally 50 gauge, but other gauges can be used to optimize the storage and rupturing requirements of contents 56 of the reservoir 22.

The absorbent application layer 36 is an absorbent layer generally in the form or a cloth, foam/sponge or other suitable impregnatable material formed from polyester, polyester blended with regenerated cellulose fiber, polypropylene blended with cellulose pulp, and cotton. In some example embodiments, these materials may be medical grade to ensure that certain criteria are met for medical and pharmaceutical applications of the applicator device. Further, the application layer 36 may be made of a surgical sponge in one example embodiment. In another example embodiment, the application layer 36 may vary in abrasiveness depending on the intended use of the applicator device 10. In some embodiments, the application layer 36 is cut to the perimeter 28 of the upper portion 20 of the applicator device 10. Further, the thickness of the application layer 36 can be any thickness understood by those skilled in the art to be useful for a particular applicator device 10. For example, in some embodiments, the thickness is between about 0.2-2.5 mm or 30-65 gsm.

The application layer 36 not only acts to absorb the contents of the reservoir 22, but may, in some embodiments, be impregnated with content 56 to react with the contents 56 contained within the reservoir 22. In one embodiment, the application layer 36 may be impregnated with a dry substance, such as a powder, to later react with liquid contents within the reservoir 22. In another embodiment, the application layer 36 may be soaked in a liquid which then dries and is later combined with the contents 56 of the reservoir 22 upon use of the applicator.

Moreover, in one embodiment, the application layer 36 has a cover over it. The cover over the application layer 36 acts to prevent contamination of the application layer 36. Further, in some embodiments, the cover acts to keep any dry contents impregnated in the pad 36 from reacting with the environment or any other reagent. The cover may be removably placed on the applicator device 10 in several ways. In one embodiment, the cover is snapped onto the applicator device 10 to cover the application layer 36. To retain the cover in an embodiment where the cover is snapped on, the protective film 24 contains a ridge around the perimeter 28 which allows the cover to be removably retained. The ridge that extends around the perimeter 28 may also be used to allow a cover to be placed over the pad 36 using a groove and lip method, in another embodiment. In such an embodiment, the ridge that extends around the perimeter 28 may have either a lip or a groove to releasably engage a cover. In another embodiment, the ridge does not extend around the perimeter 28 in one continuous structure. Rather the ridge has spaces to allow for be placed through the discontinuities in the ridge and then twisted into a locked position.

In another embodiment, the cover is removably retained over the pad using a threaded cover. In such an embodiment, the perimeter 28 of the applicator device 10 would act as a guide for a threaded cover to be placed over the application layer 36. To ensure that the perimeter 28 of the applicator device 10 is sturdy enough to engages the threads of a threaded cover, the first seal area 32 may be made thicker in one embodiment. In another embodiment, the application layer 36 contains threads that are to be engaged by the threads inside of a cover. In yet another embodiment, the cover is a film that may be placed over a wet application layer 36. In such an embodiment, the cover may have an elastic material around its perimeter. In an example embodiment, the elastic material around the perimeter would allow the cover to be stretched over the perimeter 28 of the applicator device 10 and then return to its resting size which is smaller than the perimeter 28 of the applicator device 10. In another embodiment, the cover is a film that is releasably applied to a wet application layer 36. The cover, in such an embodiment, may be peeled off the application layer 36 because the cover clings onto the pad due to the hydrophilic nature of the film. In an example embodiment, the cover has one side that releasably engages the wet application layer 36 and the other side is sealed to not allow any of the contents of the wet pad to flow through.

Thus, the applicator device 10 may still be stored and handled even if the applicator layer 36 is wet. An example embodiment of such a cover allows for the applicator layer 36 to be impregnated with liquid or gel contents rather than a solid, dry substance further expanding the use and applicability of the applicator device 10. Moreover, the cover can be retained by any means well understood in the art, such as a hinge whereby a single use can then be covered for later use of the applicator device.

In yet another embodiment, the cover hermetically seals the applicator layer 36. A hermetic seal over the applicator layer 36 will allow the applicator device 10 to be airtight and limits possible contamination of the contents of the applicator device 10 as well as the applicator layer 36. An example embodiment with a hermetically sealed cover may allow for the applicator device 10 to have pharmaceutical and medical applications. In an example embodiment of a hermetically sealed cover, the cover may be a foil that is sealed along the perimeter 28 of the reservoir 22. Such a hermetically sealed cover will ensure that the contents 56 as well as the applicator layer 36 will remain contamination free and ensure sanitary conditions when the applicator device 10 is used in medical or pharmaceutical settings. Moreover, such a seal being of foil will allow any content on the pad to remain in the dark preventing light exposure.

Figure 4:
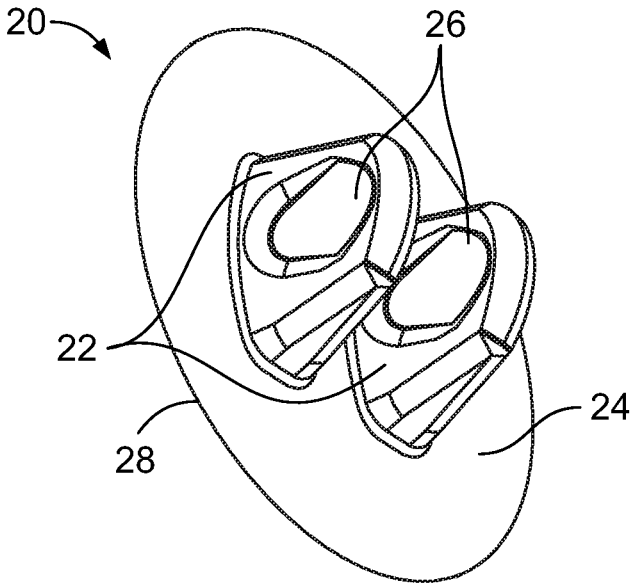
FIG. 4 is an example embodiment of an upper portion of an applicator with a plurality of reservoirs from a top view.

Turning now to FIG. 4, this figure illustrates an example embodiment of an upper portion 20 of an applicator device 10 with a plurality of reservoirs 22*a*, 22*b* from a top view. In brief, a plurality of reservoirs 22*a*, 22*b*, a protective film 24, a perimeter 28, and engagement points 26 are depicted. Like FIG. 1, in one example embodiment, the plurality of reservoirs 22*a*, 22*b* is extruded from a protective film 24. The protective film 24, thus, protects against contacting the application layer 36 and allows for ease of use with the applicator device 10. Further, a first film 34 is fixedly attached to the protective film 24 by way of a heat and pressure seal. An application layer 36 is then fixedly attached to the protective film 24 by a heat and pressure seal.

In one embodiment, the plurality of reservoirs 22*a*, 22*b* is used to hold the same contents 56. In another embodiment, the plurality of reservoirs 22*a*, 22*b* is used to hold two distinct contents 56. In yet another embodiment, the plurality of reservoirs 22*a*, 22*b* is used to hold two distinct contents 56 that cannot be combined until the contents 56 of the applicator are to be used. In some embodiments, the plurality of reservoirs 22*a*, 22*b* allows greater control of the combination and distribution of the contents 56. A pressure or force may be applied to the plurality of reservoirs 22*a*, 22*b*, in some embodiments, either at the same time or one at a time. By applying the pressure or force to one reservoir at a time, the contents 56 may be controllably released from the selected reservoir 22*a* or 22*b* onto the application layer 36. For example, in one embodiment, the application layer 36 may be impregnated with a dry substance to be engaged by the contents 56 of one of the plurality of the reservoirs 22*a* or 22*b*. Such control allows for a controlled reaction and interaction of substances in the reservoir 22*a* or 22*b* and the application layer 36. In another embodiment, the contents 56 of the plurality reservoirs 22*a*, 22*b* must be held separate until use of the applicator. In such an embodiment, the content 56 in the plurality of reservoirs 22 is two distinct substances that must be combined prior to application to achieve a desired effect.

Figure 5:
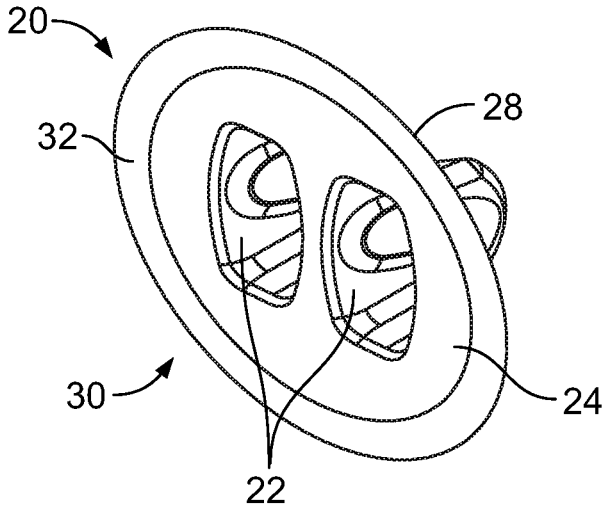
FIG. 5 is an example embodiment of an upper portion of an applicator with a plurality of reservoirs from a bottom view.

Referring to FIG. 5, this figure illustrates an example embodiment of an upper portion 20 of an applicator device 10 with a plurality of reservoirs 22*a*, 22*b* from a bottom view. In brief, a dispensing end 30, a protective film 24, at a first reservoir 22*a*, 22*b*, a perimeter 28, and a first seal area 32 is depicted. Like FIG. 2, the first film 34 is heat and pressure sealed to the perimeter 28 of the protective film 24 which creates a first seal area 32. The first seal area 32 ensures the contents 56 within the reservoir 22 are contained until use and during transport or storage. In one embodiment, there is only one heat and pressure seal along the perimeter 28 of the protective film 24. In such an embodiment, the contents 56 of the reservoirs 22*a*, 22*b* may be the same. In another embodiment, the contents 56 may be distinct contents but able to be combined prior to use. In yet another embodiment, there is an additional heat and pressure seal that separates the two reservoirs 22*a*, 22*b* to create two distinct volumes—one for each respective reservoir 22. In such an embodiment, the applicator device 10 may contain two distinct contents 56 which must be held separate until use of the applicator device 20. In one embodiment, the first film 34 that is heat and pressure sealed to the protective film 24 has at least one frangible aperture 48, 50, 52 that may burst or rupture to allow the contents 56 to flow from the reservoir 22 through the first film 34 to the absorbent pad 36. In some embodiments, the at least one frangible aperture 48, 50, 52 is a plurality of micro-perforations 48 (FIG. 8A) or a port 52 with a pull tab 54 (FIG. 8C) covering the port 52. In one embodiment, the two distinct contents 56 mix together in the absorbent application layer 36. In yet another embodiment, the application layer 36 is impregnated with a dry substance. The plurality of reservoirs 22*a*, 22*b* has contents 56 that are to be mixed with the dry substance that is impregnated in the application layer 36.

Turning now to FIGS. 7A-E, these figures illustrate an example embodiment of an applicator device 10 with at least one divider film 40 within the reservoir 22 viewed from the side. The divider films 40 act to create at least one volume 42, 44, 46 within the volume of the reservoir 22. The creation of more than one volume 42, 44, 46, in an example embodiment, may be used to separate distinct contents 56 that cannot be combined until the applicator is to be use. In another example embodiment, the at least one divider film 40 is used to control the combination of contents 56 to prepare a solution that is placed on a selected surface.

Figure 7A:
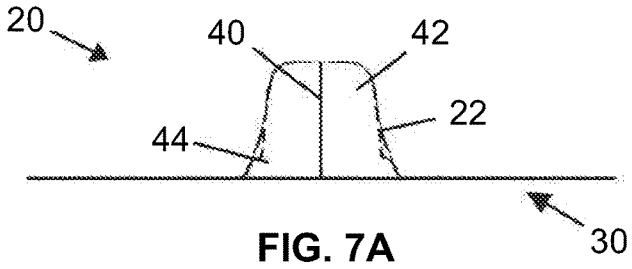
FIG. 7A-7E are example embodiments of an applicator with at least one divider film in the reservoir.
Figure 7B:
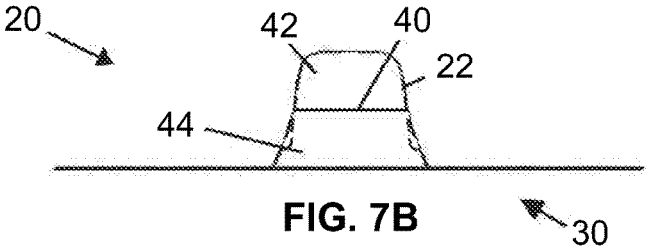

FIGS. 7A and 7B depict example embodiments of a vertical divider film 40 and a horizontal divider film 40, respectively. The divider films 40, in an example embodiment, contain at least one frangible apertures 48, 50 to allow the contents of one volume 42, 44, 46 to combine with the contents 56 of another volume 42, 44, 46. In such an example embodiment, the pressure required to rupture or burst the at least one frangible aperture 48, 50 of the divider film 40 may be less that the pressure required to rupture or burst the at least one frangible aperture 48, 50 of the first film 34 to ensure that the divider film 40 allows the contents 56 to mix before the contents 56 flow through to the absorbent pad 36. However, in another example embodiment, the at least one frangible aperture 48, 50 in the first film 34 may require less pressure to rupture or burst than the at least one frangible aperture 48, 50 of the divider film 40. In such an embodiment, one content 56 of the reservoir 22 may be applied to a surface follow by a second content 56 at some later point. For example, when applying several coats of varnish to a floor or when applying several layers of a face wash. Another example use may be in the application of multi-step acne medicine that requires different types of medicines to be applied at different times. With multiple distinct volumes 42, 44, 46 within the reservoir 22, the applicator may hold multiple different medicines to be applied one by one by varying the pressure required to burst or rupture the at least one frangible aperture 48, 50.

Figure 7C:
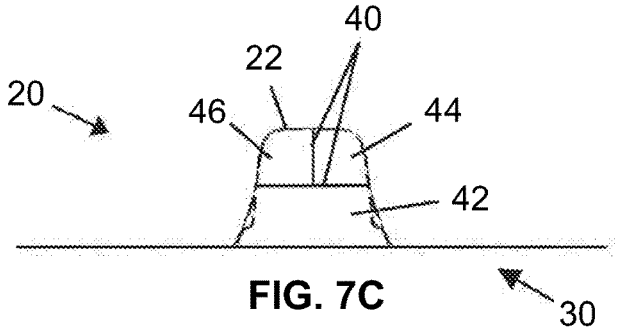
Figure 7D:
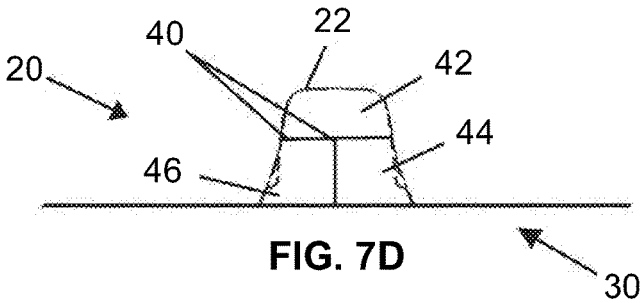
Figure 7E:
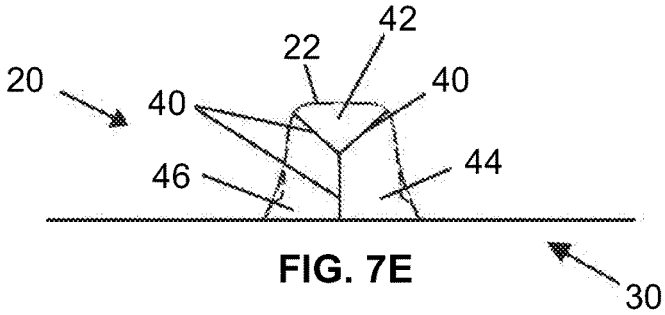

FIGS. 7C, 7D, and 7E depict some example embodiments of a reservoir 22 containing multiple volumes 42, 44, 46 created by at least one divider film 40. Like FIGS. 7A and 7B, the divider films 40 allow the reservoir 22 to hold multiple contents 56 that either cannot be mixed or must be mixed immediately prior to use of the applicator device 10. Further, in an example embodiment, the at least one divider film 40 has at least one frangible aperture 48, 50 to allow for the contents 56 within the multiple volumes 42, 44, 46 to be mixed prior to being absorbed by the pad 36.

Turning now to FIGS. 16-18 and FIGS. 23-25, these figures illustrate in isometric and exploded, side elevation views additional embodiments of an applicator device 10 according to the present invention. As with the previously disclosed and described applicator devices, the applicator device 10 generally comprises an upper portion 20 formed from a protective film 24, a first film 34, and an application layer 36. The upper portion 20 includes at least a first reservoir, namely, a first 22 (FIGS. 16-18) or a plurality of reservoirs 22*a*, 22*b* (FIGS. 23-25) formed therein, a first, outer perimeter 28*a* at the outer edge of the protective film 24 and a second, inner perimeter 28*b* around the at least a first reservoir 22 or 22*a*, 22*b*. The applicator device 10 further comprises a sealing layer 138 overlying the application layer 36. A tab or gripping portion 138*a* extends from the periphery of the sealing layer 138.

The upper portion 20 further comprises at least one engagement point 26. As seen in these figures, the engagement points 26 are placed on the exterior of the reservoir 22 and may take the form of ridges, divots, or indentations in certain embodiments. These engagement points 26 may provide ergonomic comfort, and in another embodiment, may provide guidance as to how and where to apply the pressure required to burst either a capsule 56 within the reservoir 22, a divider film 40 within the reservoir 22, or frangible aperture 48, 50, 52 in the first film 34. The internal volume of the reservoir 22 may further include at least one second, divider film 40 further dividing the internal volume of the reservoir 22 in smaller volumes 42, 44, 46.

The applicator device 10 in these figures is assembled by first securely affixing the upper portion 20 of the applicator device 10 to the first film 34 through a heat and pressure process. A first, outer seal or weld forms between the protective film 24 and the first film 34 at the outer seal area 32*a* between perimeter 28*a* and the outer circumferential dashed line in FIG. 17. A second, inner seal or weld is formed around the reservoir perimeter 28*b* at the inner seal area 32*b* between the reservoir perimeter 28*b* and the inner circumferential dashed line in this figure. The inner seal or weld ensures contents remain in the reservoir 22 while the applicator device 10 is not in use. The second, inner seal or weld improves the disbursement of the contents of the reservoir 22 during operation of the applicator device 10 by preventing pooling of the reservoir contents between the upper portion 20 of the applicator device and the first film 34.

The first film 34 may also be sealed welded to the protective film 24 using other thermal welding techniques which includes, but is not limited to, hot gas welding, hot wedge welding, extrusion welding, hot plate welding, infrared welding, and laser welding. In another embodiment, the protective film 24 may be sealed to the first film 34 using mechanical welding techniques which include, but are not limited to, spin welding, stir welding, vibration welding, and ultrasonic welding.

In yet another embodiment, the protective film 24 is affixed to the first film 34 using electromagnetic welding techniques, which include, but are not limited to, resistance/implant/electrofusion welding, induction welding, dielectric welding, and microwave welding. When the at least one reservoir includes the first and second reservoirs 22*a*, 22*b* shown in FIGS. 24-25, the second, inner seal comprises a circumferential seal extending around the periphery of the first and second 22*a*, 22*b* and divider seal preserving the separation of the first and second reservoirs 22*a*, 22*b*. In both variations, the outer seal provides a second barrier against leakage from the reservoir 22 should the inner seal fail.

The application layer 36 is affixed to the first film 34 by way of heat and pressure seal at the perimeter 28*a* of the upper portion 20. The heat and pressure seal acts to ensure the contents of the reservoir 22 are absorbed by the application layer 36 and the do no leak out of the sides of the applicator device 10. In this arrangement the at least one reservoir 22 and application layer 36 come into fluid communication, via the first film 34, such that contents leave the reservoir 22, flow through the first film 34 via at least one frangible aperture 48, 50, 52 (as described in detail above) and to the application layer 136. The application layer 36 is then soaked with the contents of the reservoir 22 and can be applied to a surface.

And finally, the sealing layer 138 is affixed to application layer 36. The sealing layer 138 is affixed to the applicator device 10 over the application layer 36 and serves to keep the application layer 36 clean and free from environmental contaminants prior to use of the applicator device 10. In one embodiment the sealing layer 138 comprises a sealing label and provides an additional protective barrier against premature seepage of contents from the reservoir 22. The sealing layer 138 is preferably composed of a foil, vinyl or paper and affixed to the application layer 36 through suitable means. In one embodiment, a vinyl or foil label is sealed to the application layer 36 at the perimeter with a lamination process. The lamination material offers the added benefit of filling the sides of the application layer 36 to form a complete seal and breaks away from the application layer during the removal of the label. In another embodiment, the sealing layer 138 comprises a paper substrate affixed to the application layer 36 with an adhesive and is peelable to expose the application layer 36. With a suitable sealing layer 138, the applicator device 10 may still be stored and handled even if the application layer 36 is wet.

Figure 23:
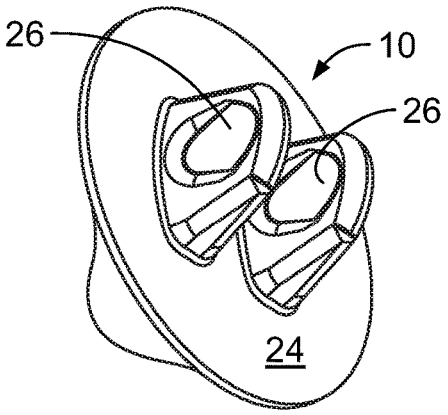
FIG. 23 is an isometric view of an applicator according to an embodiment of the present invention having at least a first reservoir.
Figure 24:
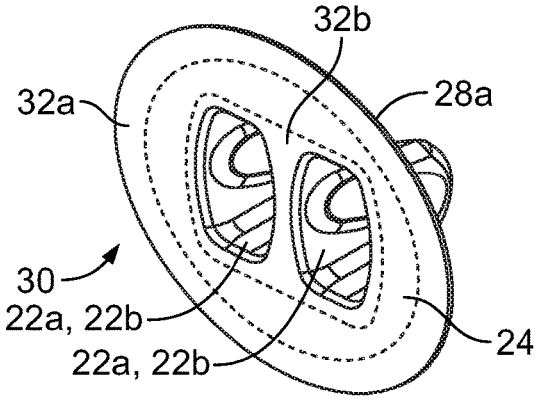
FIG. 24 is an isometric view of a component of the applicator shown in FIG. 23.
Figure 25:
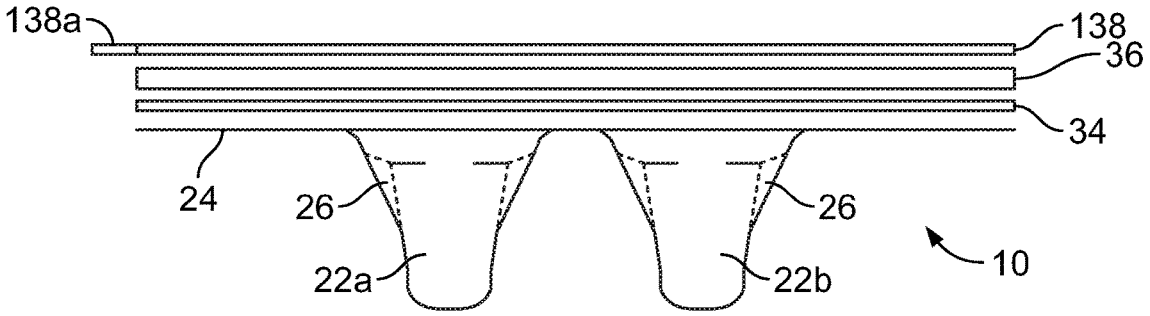
FIG. 25 is an exploded, side elevation view of the applicator of FIG. 23.

In the applicator device 10 shown in FIGS. 23-25, the at least one reservoir 22 comprises a first and second reservoirs 22*a*, 22*b* that may be used to hold the same contents. In another embodiment, the first and second reservoirs 22*a*, 22*b* hold two distinct contents. In yet another embodiment, the first and second reservoirs 22*a* 22*b* is used to hold two distinct contents that cannot be combined until the applicator device 10 is in use. In some embodiments, the plurality of reservoirs 22*a*, 22*b* allows greater control of the combination and distribution of the reservoir contents. A pressure or force may be applied to the plurality of reservoirs 22*a*, 22*b*, in some embodiments, either at the same time or one at a time. By applying the pressure or force to one reservoir at a time, the contents may be controllably released from the selected reservoir 22*a*/22*b* onto the application layer 36. For example, in one embodiment, the application layer 36 may be impregnated with a dry substance to be engaged by the contents of the first or second reservoir 22*a*, 22*b*. Such control allows for a controlled reaction and interaction of substances in the reservoir 22 and the application layer 36. In another embodiment, the reservoir contents must be held separate until use of the applicator device 10. In such an embodiment, the contents in the first and second reservoirs 22*a*, 22*b* is two distinct substances that must be combined prior to application to achieve a desired effect.

Referring to FIGS. 19-20, 22, 26, as with other embodiments described above, the first film 34 comprises at least one frangible aperture 48, 50, 52 transformable between a first, closed state and second, open state allowing the contents of the at least a first reservoir 22 or 22*a*, 22*b* to access the application layer 36. To access the application layer 36, the at least one frangible aperture 48, 50, 52 must be ruptured or burst. To rupture or burst the at least one frangible aperture 48, 50, 52, a force or pressure must be applied to reservoir 22. Such application of force or pressure, in one embodiment, may be applied directly to the engagement points 26 on the reservoir 22. In another embodiment, the force or pressure may be applied anywhere on the reservoir 22. Once the force or pressure is applied to the reservoir 22, there is a buildup of internal pressure within the reservoir 22 that then causes the frangible aperture 48, 50, 52 to rupture or burst.

Figure 19:
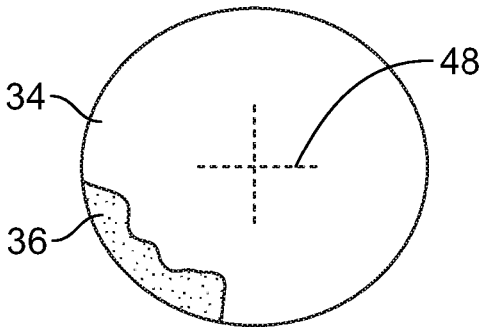
FIG. 19 and FIG. 20 are elevation and partial cutaway views of another component of the applicator shown in FIG. 16 having at least one frangible aperture.
Figure 26:
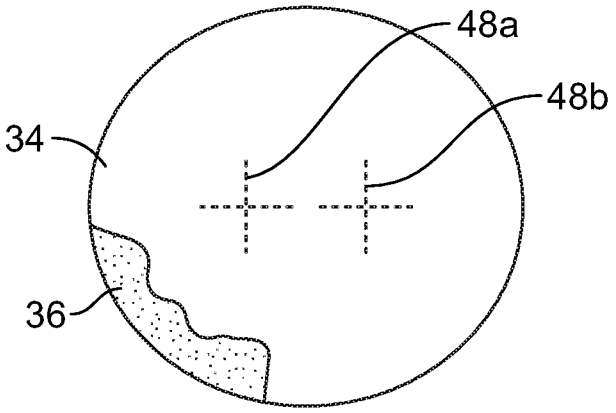
FIG. 26 is an elevation and partial cutaway view of a component of the applicator of FIG. 23 having at least one frangible aperture.
Figure 27:
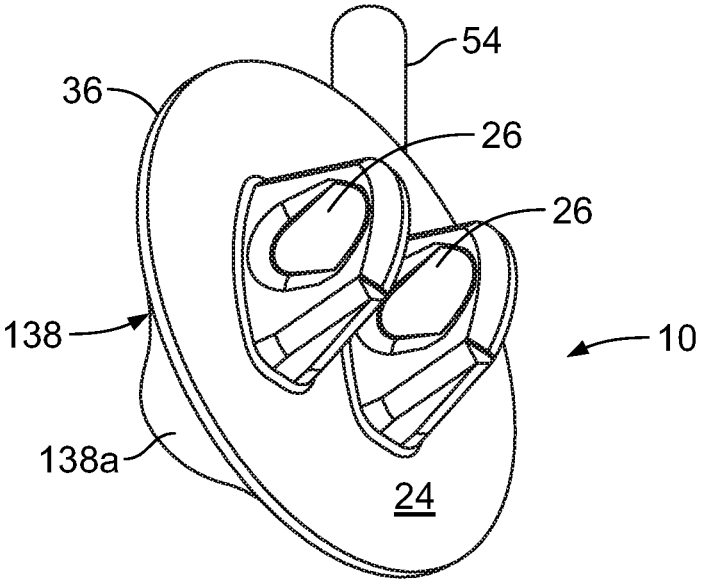
FIG. 27 is an isometric view of another applicator according to the embodiment of the present invention having at least a first reservoir.

The frangible aperture shown in FIG. 19 and FIG. 26 is a plurality of micro-perforations 48 that are 1-3 millimeters apart and preferable have a rupture or burst strength of 0.5-1.0 psi. In one embodiment, the plurality of micro-perforations 48 forms an X or cross pattern. The X pattern, when torn, creates a large opening through which liquid can flow. When the applicator device 10 includes a single reservoir 22 (FIG. 17), a single micro-perforation frangible aperture 48 is employed. When the applicator device 10 includes at least a first reservoir, and, by way of example, a first and second reservoir 22*a*, 22*b* (FIG. 24) a first and second micro-perforation frangible aperture 48*a*, 48*b* are associated with and overlay each of the reservoirs 22*a*, 22*b*. In alternative embodiments other geometric patterns may be used. In yet other embodiments, the frangible aperture is a plurality of macro-perforations.

Figure 20:
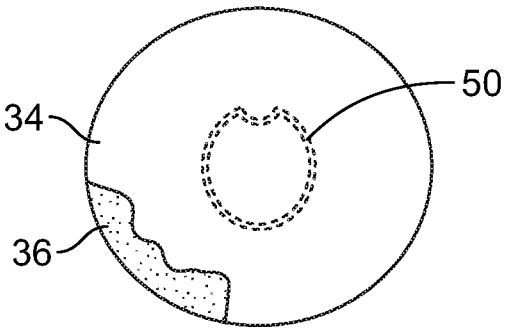
Figure 21:
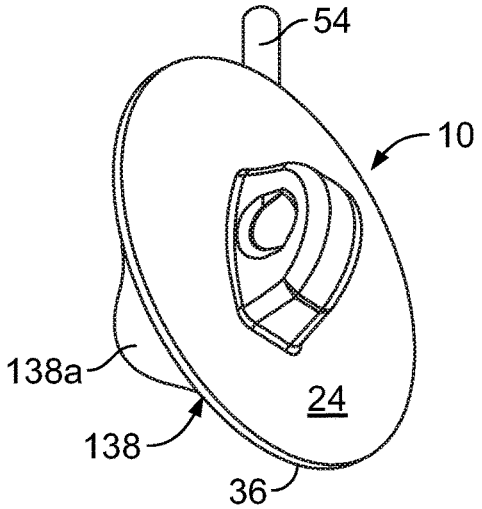
FIG. 21 is an isometric view of another applicator according to the embodiment of the present invention having a single reservoir.

The frangible aperture shown in FIG. 20 is a set of seals 50. In such an embodiment, the first film 34 does not have micro-perforations. Rather, there is a pair of U-shaped lines of differential sealing. To create such an example embodiment, a sheet of the first film 34 is aligned against a corresponding end of the upper portion 20 of the applicator 10 and sealed in two steps. The form/fill/seal apparatus seals the two layers around approximately ⅞ of the outer perimeter 28*a* with a first pressure. Then, the apparatus seals the remaining ⅛ of the perimeter 28*a* with a weaker seal, in a U-shaped line. By applying a force or pressure to the reservoir 22, the contents of the reservoir 22 or the air within the reservoir 22 will cause the weaker seal to rupture or burst. Once the weaker seal is ruptured or burst, the contents of the reservoir 22 may flow through to the application layer 36. In an example embodiment, a force or pressure of 0.5-1.0 psi will cause the weaker seal to rupture or burst. In other embodiments, the second weaker seal may take the form a different shape such as, but not limited to, a triangle or oval. In yet another embodiment, the second weaker seal may be a fluid continuation of the shape of the first seal. In such an embodiment, there may be an identifying mark on the upper portion 20 of the applicator 10 to indicate the location of the weaker seal.

Figure 22:
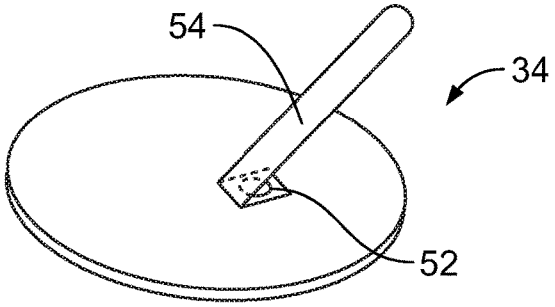
FIG. 22 is an isometric view of a component of the applicator of FIG. 21.
Figure 28:
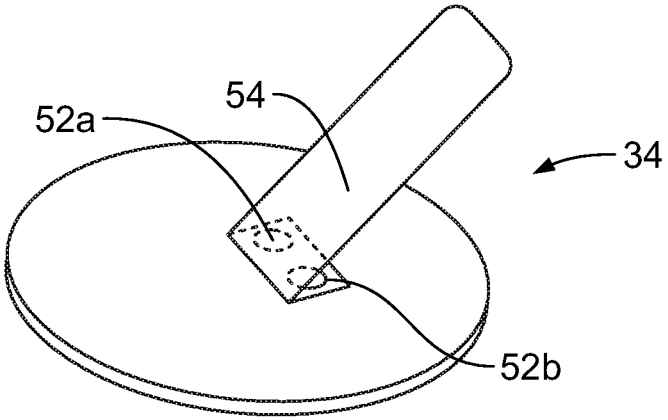
FIG. 28 is an isometric view of a component of the applicator of FIG. 27.

In FIG. 22 and FIG. 28 the frangible aperture is at least one port 52 covered by a pull tab 54. The pull tab 54 extends past the housing perimeter 28*a* and once pulled and separated from the first film 34, opens the at least one port 52 allowing the contents of the reservoir 22 to flow through to the absorbent application layer 36. When the applicator device 10 includes a single reservoir 22, only a first port 52 aligned to overly the reservoir 22 is employed. When the applicator device 10 includes at least one reservoir, and, by way of example, a first and second reservoir 22*a*, 22*b* a first and second port 52*a*, 52*b* are associated with and overlay each of the reservoirs 22*a*, 22*b*. A single tab 54 may be utilized to cover the first and second ports 52*a*, 52*b*. The pull tab 54 can be used with any embodiment of the frangible aperture 48, 50, 52 and is configured to allow fluid communication between the reservoir 22 and the application layer 36.

Figure 29:
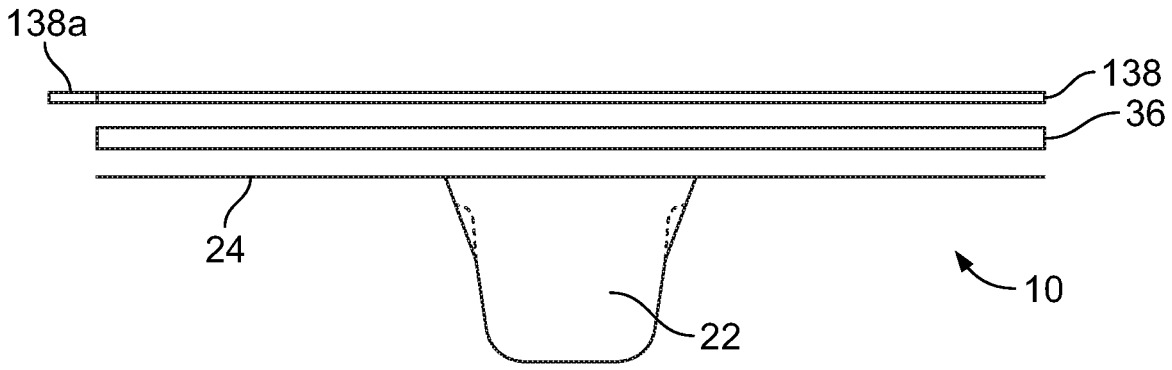
FIG. 29 is an exploded, side elevation view of another applicator according to the embodiment of the present invention having a single reservoir.

Turning to FIG. 29, an embodiment of the present invention eliminating the first film layer from other embodiments is shown. The applicator device in this figure generally comprises the protective film 24, at least one reservoir 22, application layer 36, and sealing layer 138. The use of the sealing layer 138 enables some or all of the content of the at least one reservoir 22 to impregnate the application layer 36 but avoids the impregnated application layer 36 becoming dried out or contaminated though exposure to the external environment or leak out the side of the applicator device 100 before the intended use.

Figure 9:
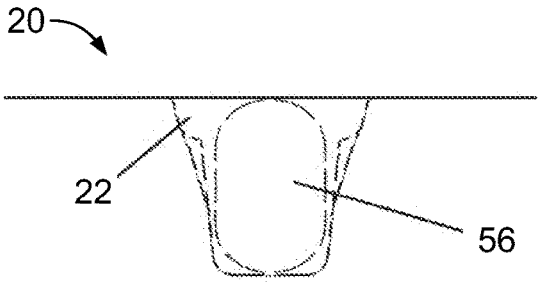
FIG. 9 is an example embodiment of an applicator with contents within the reservoir from a side view.
Figure 10:
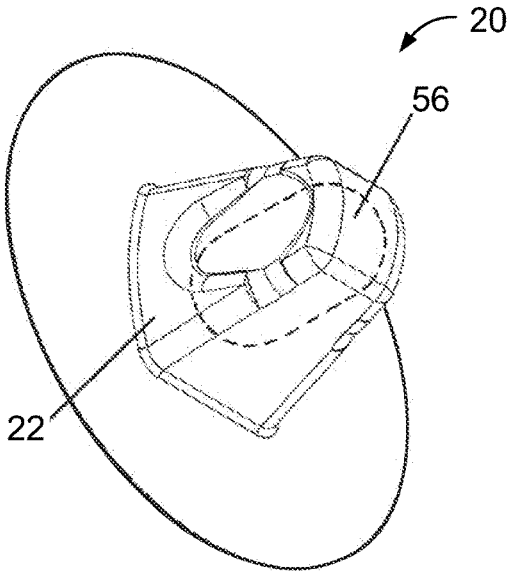
FIG. 10 is an example embodiment of an applicator with contents within the reservoir from a top view.
Figure 11:
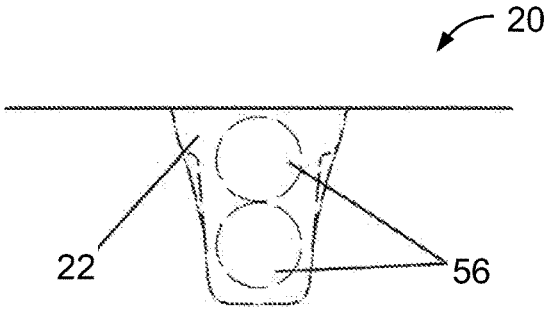
FIG. 11 is an example embodiment of an applicator with contents within the reservoir from a side view.
Figure 12:
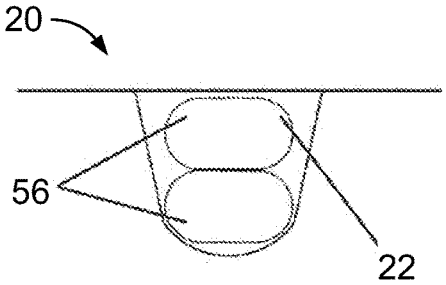
FIG. 12 is an example embodiment of an applicator with contents within the reservoir from a side view.

Turning now to FIGS. 9, 10, 11, and 12, these figures illustrate example embodiments of the applicator device 10 showing a possible content 56 within the reservoir 22. In brief, an embodiment of an upper portion 20 of an applicator device 10, an example embodiment of content 56, and a reservoir 22 are depicted. The figures show one embodiment of a content 56 in the reservoir 22 which is a capsule 56. However, in some embodiments, the content 56 within the reservoir 22 may be liquid, gel, powder, capsule, ampoule, pressed pill, crystalized solid, or a combination thereof. FIGS. 9 and 10 show multiple views of an example embodiment of the upper portion 20 of an applicator with at least one capsule the contains content 56. FIGS. 11 and 12 show multiple views of an example embodiment of an upper portion of an application 20 with a plurality of capsule that contain the content 56.

In some embodiments, the capsules 56 contain a liquid, a gel, a crystalized solid or powder. Further, the capsule 56, in some embodiments, may be a soft-shell capsule made from a gelatin material. In another embodiment, the capsule may be made from a non-gelatin material. In some embodiments, it may be required that the capsule 56 be popped by squeezing the reservoir 22. In another embodiment, the capsules 56 may be dissolvable. In such an embodiment, the dissolvable capsule would begin to dissolve once in contact with a dissolving agent within the reservoir 22. Thus, an example application of the capsule 56 as content 56 in an embodiment of the applicator device 10 may be a capsule 56 with powder inside the capsule and liquid within the reservoir with the capsule 56. Once the capsule 56 is popped, then the powder can interact and react with the liquid to create a substance to be applied to a selected surface. In another example embodiment, the opposite may be true; the capsule 56 may contain a liquid while a powder may be in the volume of the reservoir 22. In such an embodiment, the capsule 56 would be popped and the liquid could then react and interact with the powder prior to application on a selected surface. However, the preceding example embodiments should not be construed to limit the application of a capsule 56 as the content 56 within the reservoir 22. Any of the previously mentioned example contents 56 may be substituted in the preceding example embodiment. Further, the content 56 of a capsule 56 and the content 56 in the volume of the reservoir 22 will dictate the material and consistency of the capsule 56 to best serve the purpose of the particular applicator device 10.

In another example embodiment, a capsule or ampoule containing content 56 may be placed within a second volume within the inner volume of the reservoir 22. In such an example embodiment, the remaining volume of the reservoir 22 may be filled with a liquid that is to be frozen. Once frozen, the liquid will act to keep the capsule or ampoule cool until use. The frozen liquid may be thawed immediately prior to use in one application or the frozen liquid may be thawed overtime to preserve the contents within the capsule or ampoule, for example, during transport, in another application. While the above embodiments discuss the application of a frozen liquid to keep a capsule or ampoule with contents 56 cold, it should not be seen to limit the use of a frozen liquid within the reservoir 22. In another example, the reservoir 22 may be split into multiple volumes wherein a volume between the multiple volumes is a frozen liquid or gel used as a buffer between the multiple volumes. In such an example, the frozen liquid may also act to cool the multiple volumes within the reservoir 22.

In yet another example embodiment, the content 56 within the reservoir 22 may be stored within an ampoule that is placed in the inner volume of the reservoir in another example embodiment. The ampoule may be made of glass or from a plastic. Traditionally, the contents of an ampoule are accessed by breaking the ampoule. However, when the ampoule is broken, there is a possibility that shards of glass may cut the user or make their way into the area that the contents of the ampoule is being used. Thus, certain embodiments take measures to protect against such problems.

In one embodiment, for example, an ampoule is placed within a sponge. The sponge with the ampoule inside is placed within the reservoir 22. The sponge is of a porosity to allow the contents 56 of the ampoule to pass while retaining the shards of glass safely within the sponge. To break the ampoule, a force or pressure is exerted on the sponge from both sides of the reservoir 22 to crush the ampoule in one embodiment. In another embodiment, the sponge with the ampoule is placed on an angle within the reservoir 22 so that a force or pressure is only required to be exerted from one side of the reservoir 22 to snap the ampoule and allow the contents to flow into the reservoir 22. Further, in some embodiments, the sponge with the ampoule may have other types of content within the reservoir 22. Examples of possible content 56 is discussed above.

In another embodiment, the at least one frangible aperture 48, 50, 52 are of a size to allow only the smallest of contents to pass through rather than ripping away and causing a large port to remain in the first film 34. By limiting the size of content that passes through the at least one frangible aperture 48, 50, 52, in some embodiments it may not be necessary for the ampoule to be in a sponge. The small size of the at least one frangible aperture 48, 50, 52 will keep all the shards of the ampoule in the reservoir 22 while allowing the contents of the ampoule to flow through the first film 34 into the pad 36. Such an embodiment also has the advantage of ensuring that the contents 56 of the reservoir 22 do not soak into that pad 36 until they are completely mixed with the rest of the contents in the reservoir 22.

In yet another embodiment, the ampoule is fixedly placed on an angle within the reservoir 22 because of at least one divider film 40. The at least one divider film 40 can ensure that the ampoule remains at a specific angle to ensure that a force or pressure applied to the reservoir 22 will cause the frangible neck of the ampoule to break and allow the contents to flow out. In another embodiment, the ampoule is placed on an angle and held in place with at least one divider film 40 and a hard, blunt object is attached to the inside of the reservoir and positioned so that the hard, blunt object rests on the frangible neck of the ampoule. Thus, a light force or pressure applied to the spot on the reservoir where the hard, blunt object is attached will contact the frangible neck of the ampoule and break it allowing the contents to flow out. The ampoule may also, in some embodiments, be placed vertically within the reservoir 22 with the tip facing the dispensing end 30 and held tightly in place with at least one divider film 40.

The use of ampoules to help keep contents 56 separate within the reservoir 22 is important for the use of example embodiments of the applicator 20 in medical or pharmaceutical settings. In some instances, in medical or pharmaceutical settings, the application of a solution requires the mixing of two solutions prior to use. An ampoule is often useful in these settings because it allows the substances to be kept in the same container yet prevents the substances from mixing. The use of an ampoule in the reservoir 22 of the applicator 20 will allow for multiple contents to be held together within the inner volume of the reservoir but held separate until they are to be used. For example, in an example embodiment an ampoule may contain a powder that is to be reconstituted with a liquid that is contained within the inner volume of the reservoir 22. After the ampoule is broken, the powder will mix with the liquid and once the solution has had enough time to interact, the solution may be applied to the desired surface. In another example embodiment, multiple ampoules may be contained within the inner volume of the reservoir 22 wherein each of the multiple ampoules contains a distinct content. These example embodiments may be used in medical applications such as sterilizing a part of a body prior to surgery, sterilizing a tool to be used during surgery, or even sterilizing a workbench in a laboratory. Further, the example embodiments may be used to apply a topical numbing solution that is created by combining the contents of the ampoule with the contents within the inner volume of the reservoir prior to a surgery or a procedure to be done at a hospital or laboratory. Overall, the use of the applicator device 10 with ampoules, in some embodiments, may address many storage stability issues of contents 56 with certain medical or pharmaceutical application.

Figure 13:
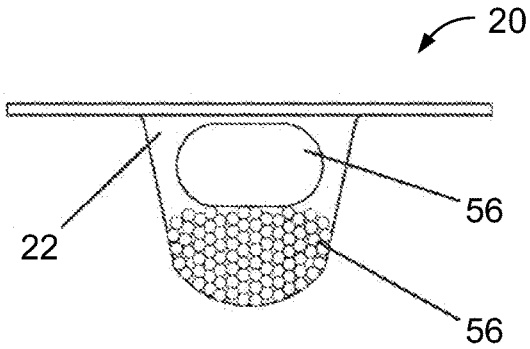
FIG. 13 is an example embodiment of an application with contents in the reservoir from a side view.

Turning now to FIG. 13, this figure illustrates an example embodiment of an applicator device 10 with an example embodiment of contents 56 within the reservoir 22 from a side view. An applicator device 20, a reservoir 22, an example embodiment of content 56 as capsules 56, and an example embodiment of content 56 as crystals 56 is depicted. The crystals 56, in one embodiment, may be salt crystals for example. In an example embodiment, the crystals 56 are affixed at the top of the reservoir 22 and the capsule 56 sits below the crystals 56 in the reservoir 22. The capsule 56 may, for example, contain a liquid that reacts with the crystals 56 to form a solution to be absorbed by the pad 36 and then placed on a selected surface. In another embodiment, the capsule 56 may contain a gel or powder that reacts with the crystals to form a solution.

Figure 14:
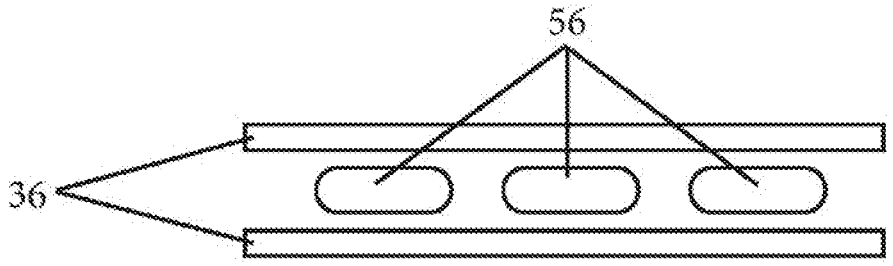
FIG. 14 is an exploded view of an example embodiment of an applicator device with contents between two sealed pads.
Figure 15:
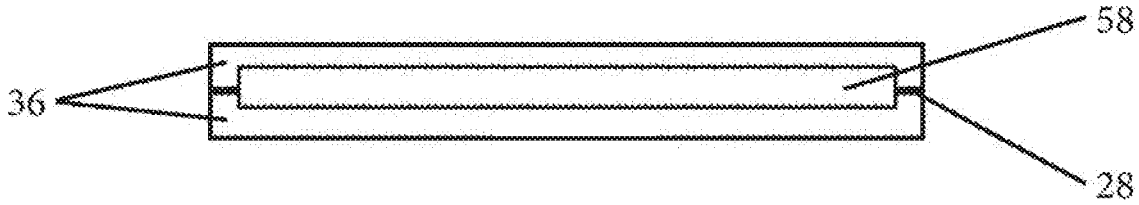
FIG. 15 is an example embodiment of an applicator device as shown in FIG. 14.
Figure 16:
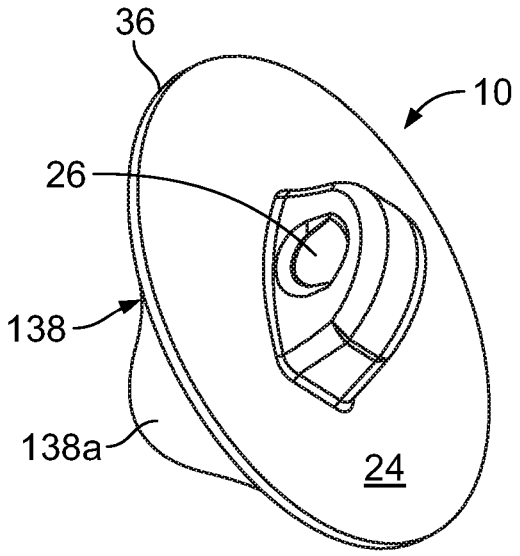
FIG. 16 is an isometric view of an applicator according to an embodiment of the present invention having a single reservoir.
Figure 17:
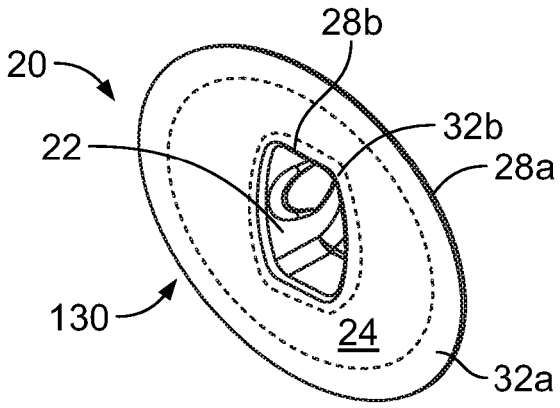
FIG. 17 is an isometric view of a component of the applicator shown in FIG. 16.
Figure 18:
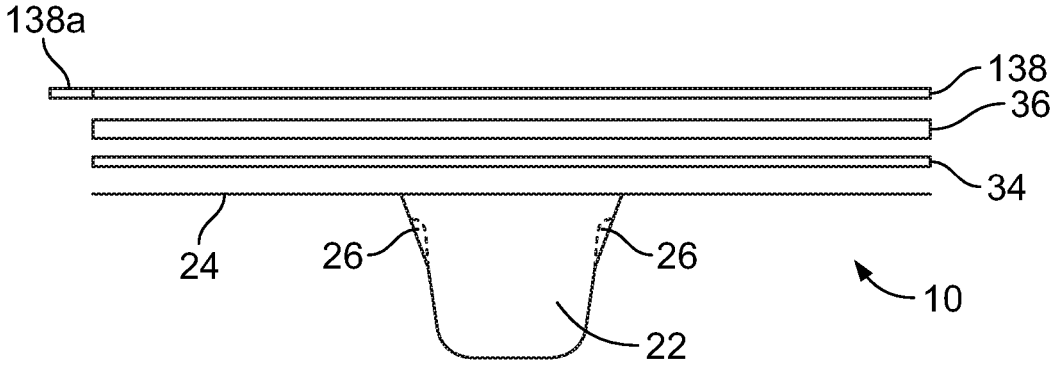
FIG. 18 is an exploded, side elevation view of the applicator of FIG. 16.

Turning now to FIGS. 14 and 15, these figures illustrates an example embodiment applicator device 10 without a reservoir 22 that has contents 56 between two application layers 36 sealed along the perimeter 28. A plurality of sealed application layers 36, an example embodiment of contents 56, a sealed perimeter 28, and a label 58 are depicted. FIGS. 14 and 15 show an example embodiment where contents 56 may be stored in the application layer 36 without the need to have a reservoir 22 attached. In an alternative embodiment, contents 56 may be stored in the application layer 36 in capsules and also in a plurality of reservoirs 22. In such an example embodiment, the contents 56 are stored between two application layers 36. The application layers 36, therefore, accomplish the same function as a reservoir 22, namely, to hold contents 56 until they are ready to be used. In such an example embodiment, content 56 is placed within at least one capsule. The at least one capsule is then placed between a plurality of sealed application layers 36. With the content 56 between the plurality of sealed application layers 36, it is now possible to use both sides of the plurality of sealed application layers 36 in some embodiments. In some embodiments, to expose the contents 56 of the capsules, the capsules must be burst. To burst the capsules, in some embodiments, a force or pressure may be applied to the plurality of sealed application layers 36 by pressing the plurality of sealed application layers 36 on a surface or the desired surface of application of the contents 56 within the plurality of sealed application layers 36. In another embodiment, the capsules are dissolved by encountering a liquid. The capsules may in some embodiments have the same or in other embodiments different contents 56, dictated by the use of the applicator device 10. The capsules with different contents may be spaced in a pattern also dictated by the use and understood to be appropriate by persons skilled in the art. In an embodiment, the plurality of sealed application layers 36 is sealed along the perimeter 28 to create a first seal area 32. The first seal area 32 ensures that no contaminants encounter the capsules before they are to be used. Thus, the capsules are not in danger of being dissolved and preemptively releasing the contents 56.

To further protect from contamination, in another embodiment, the plurality of sealed application layers 36 has a label 58 that is affixed along the side of the plurality of sealed application layers 36. An example embodiment of a plurality of sealed application layers 36 with a label is depicted in FIG. 15. The label 58 may be placed on the side of the plurality of application layers 36 in any way understood by a person of skill in the art. For example, in an example embodiment, the label 58 may be fixedly attached to the plurality of application layers 36. In another embodiment, label 58 may be removably attached to the plurality of application layers 36. In yet another example embodiment, the label 58 covers a portion of a side of the plurality of sealed application layers 36. In another embodiment, the label 58 covers the entirety of a side of the plurality of sealed pads 36. In yet another embodiment, the label 58 is placed on at least one side of the plurality of sealed pads 36. Further, the label 58 may be put in other places with varying dimensions and geometric shapes as would be known to a person of skill in the art in other embodiments. Moreover, the label 58 placed on the side of the plurality of sealed application layers 36 may be used for multiple purposes depending on the desired application and based on the knowledge of a person of skill in the art. For example, in one embodiment, the label 58 serves as an additional means for ensuring the contents 56 remain free from contamination. In another embodiment, the label 58 may be used for advertising. In yet another embodiment, the label 58 may be used to display information about the contents 56 within the plurality of application layers 36. In some embodiments where there is more than one content 56 in the plurality of application layers 36, the label 58 or a plurality of labels 58 can be used to illustrate to a user where particular capsules containing particular content 56 is located by the placement and indication on the label 58.

While a preferred embodiment of the applicator device has been described in detail, it should be apparent that modifications and variations thereto are possible, all of which fall within the true spirit and scope of the disclosed applicator device. With respect to the above description then, it is to be realized that the optimum dimensional relationships for the parts of the disclosed applicator, to include variations in size, materials, shape, form, function and manner of operation, assembly and use, are deemed readily apparent to one skilled in the art, and all equivalent relationships to those illustrated in the drawings and described in the specification are intended to be encompassed by the disclosed applicator device.

Throughout this specification, unless the context requires otherwise, the word "comprise" or variations such as "comprises" or "comprising" or the term "includes" or variations, thereof, or the term "having" or variations thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the disclosed applicator device given that the essential features of the disclosed applicator device as claimed are included in such an embodiment.

Those skilled in the art will appreciate that the applicator device described herein is susceptible to variations and modifications other than those specifically described. It is to be understood that the disclosed applicator device includes all such variations and modifications that fall within its spirit and scope. The disclosed applicator device also includes all the steps, features, compositions and compounds referred to or indicated in this specification, individually or collectively, and any and all combinations of any two or more of said steps or features.

Therefore, the foregoing is considered as illustrative only of the principles of the applicator device. Further, since numerous modifications and changes will readily occur to those skilled in the art, it is not desired to limit the applicator to the exact construction and operation shown and described, and accordingly, all suitable modifications and equivalents may be resorted to, falling within the scope of the disclosed applicator device.

What is claimed is:

1. An applicator device comprising:

a protective film wherein an enclosure in the protective film defines an inner volume of at least one reservoir, the enclosure having an opening at a proximal end of the at least one reservoir, an outer perimeter at an outer edge of the protective film and an inner perimeter around the at least one reservoir;

a first film fixedly attached to the protective film at a first seal at the outer perimeter and at a second seal at the inner perimeter, the first film further comprising at least one opening disposed therethrough within the inner perimeter; and an application layer fixedly attached to the first film.

2. The applicator device of claim 1 further comprising a sealing layer removedly attached to the application layer.

3. The applicator device of claim 2 wherein the sealing layer is laminated to the application layer.

4. The applicator device of claim 2 wherein the sealing layer is adhered to the application layer.

5. The applicator device of claim 1, wherein the at least one opening disposed through the first film is a plurality of macro-perforations.

6. The applicator device of claim 1, wherein the at least one opening disposed through the first film is a frangible aperture comprising a plurality of micro-perforations.

7. The applicator device of claim 1, wherein the at least one opening disposed through the first film is at least one port, and the at least one port is covered by a pull tab which extends beyond the reservoir.

8. The applicator device of claim 6, wherein the frangible aperture comprising the plurality of micro-perforations is a burst seal within the perimeter of the reservoir, the burst seal having a burst pressure that is less than a burst pressure of the second seal.

9. The applicator device of claim 1, wherein the application layer is impregnated with at least one of dry components or liquid components.

10. An applicator device comprising:

an upper portion wherein an enclosure defines an inner volume of a plurality of reservoirs, the enclosure having an opening at a proximal end of each of the plurality of reservoirs, an outer perimeter at an outer edge of the upper portion and an inner perimeter around each of the plurality of reservoirs;

a first film, wherein the first film is fixedly attached at least along the inner perimeters around each of the plurality of reservoirs, wherein the first film has at least one port disposed therethrough within each of the inner perimeters;

at least one pull tab that covers the at least one port disposed through the first film within each of the inner perimeters, wherein the at least one pull tab extends beyond the outer perimeter; and an application layer fixedly attached to the first film.

11. The applicator device of claim 10, wherein the at least one pull tab comprises a plurality of pull tabs, wherein each of the plurality of pull tabs covers the at least one port disposed through each of the plurality of reservoirs.

* * * * *